US006874184B2

(12) United States Patent
Chandler

(10) Patent No.: US 6,874,184 B2
(45) Date of Patent: Apr. 5, 2005

(54) LEG SUPPORT APPARATUS

(76) Inventor: Donald Chandler, 2 Royal Cir., Lexington, MA (US) 02420

( * ) Notice: Subject to any disclaimer, the term of this patent is extended or adjusted under 35 U.S.C. 154(b) by 115 days.

(21) Appl. No.: 10/463,657

(22) Filed: Jun. 17, 2003

(65) Prior Publication Data

US 2004/0255384 A1 Dec. 23, 2004

(51) Int. Cl.[7] ..... A47C 20/08

(52) U.S. Cl. ..... 5/648; 5/624; 128/845; 128/882; 248/122.1; 248/125.1

(58) Field of Search ..... 297/423.45, 423.41; 5/624, 646, 648, 623, 621, 658, 503.1; 128/845, 846, 882, 878; 602/23, 62; 248/118, 118.3, 122.1, 125.1, 218.4, 295.11

(56) References Cited

U.S. PATENT DOCUMENTS

| | | | | | |
|---|---|---|---|---|---|
| 830,776 | A | | 9/1906 | Flagg | |
| 1,516,795 | A | * | 11/1924 | Schwarting | 5/646 |
| 2,119,325 | A | * | 5/1938 | Goodhart | 602/16 |
| 2,346,722 | A | | 4/1944 | Bowman | |
| 2,581,110 | A | | 1/1952 | Kenworthy | |
| 3,007,739 | A | | 11/1961 | Delia | |
| 3,065,992 | A | | 11/1962 | Nagel | |
| 3,066,322 | A | | 12/1962 | Derby | |
| 3,753,557 | A | | 8/1973 | Kelley | |
| 4,252,306 | A | * | 2/1981 | Johnson et al. | 5/650 |
| 4,526,355 | A | * | 7/1985 | Moore et al. | 5/624 |
| 4,545,573 | A | * | 10/1985 | Murphy | 5/624 |
| 4,624,245 | A | * | 11/1986 | Mullin et al. | 602/38 |
| 4,662,619 | A | * | 5/1987 | Ray et al. | 5/624 |
| 4,809,687 | A | * | 3/1989 | Allen | 602/4 |
| 4,886,258 | A | * | 12/1989 | Scott | 5/624 |
| 4,913,413 | A | * | 4/1990 | Raab | 5/624 |
| 5,025,802 | A | * | 6/1991 | Laico et al. | 128/882 |
| 5,056,535 | A | * | 10/1991 | Bonnell | 128/882 |
| 5,063,918 | A | * | 11/1991 | Guhl | 602/40 |
| 5,281,001 | A | * | 1/1994 | Bergsten et al. | 297/411.24 |
| 5,290,220 | A | * | 3/1994 | Guhl | 602/33 |
| 5,390,383 | A | * | 2/1995 | Carn | 5/624 |
| 5,645,079 | A | * | 7/1997 | Zahiri et al. | 5/610 |
| 5,662,591 | A | * | 9/1997 | Peindl et al. | 601/24 |
| 5,926,882 | A | * | 7/1999 | Veith et al. | 5/658 |
| 6,012,456 | A | * | 1/2000 | Schuerch | 128/869 |
| 6,023,800 | A | * | 2/2000 | Stickley | 5/621 |
| 6,298,507 | B1 | * | 10/2001 | Clyburn | 5/623 |
| 6,622,324 | B2 | * | 9/2003 | VanSteenburg et al. | 5/621 |
| 6,629,944 | B2 | * | 10/2003 | Smart | 602/36 |
| 6,663,055 | B2 | * | 12/2003 | Boucher et al. | 248/118 |
| 6,708,935 | B2 | * | 3/2004 | Smeed | 248/118 |
| 2004/0123389 | A1 | * | 7/2004 | Boucher et al. | 5/623 |

* cited by examiner

*Primary Examiner*—Robert G. Santos
(74) *Attorney, Agent, or Firm*—Hamilton, Brook, Smith & Reynolds, P.C.

(57) ABSTRACT

A leg support apparatus is herein provided for use in the health care industry for the treatment and rehabilitation of persons having leg injuries. The apparatus includes a vertical support member having a base and a clamp which is slideably positionable on the vertical support member. The clamp is pivotably coupled to at least one cradle having a sling member. The sling member is independently pivotally coupled to the cradle permitting the sling member to tilt in an arc up and down, depending of the need of the patient. The adjustability of the vertical support assembly further provides for greater positioning thereby increasing the general comfort of the patient while providing for the patient's medical needs.

18 Claims, 5 Drawing Sheets

LEG SUPPORT APPARATUS

FIELD OF INVENTION

The present invention relates to devices for the care of patients having injuries to the lower extremities. More particularly, the present invention relates to devices which support the legs at a level above the level of the injured patient's heart.

BACKGROUND OF THE INVENTION

Significant injury to the legs can result in a long-term convalescing and residence in a facility such as a hospital or rehabilitation center until the injured person has recovered. As part of the person's treatment, a physician may require that the injured leg be elevated above the level of the person's heart for a prolonged period of time. This can lead to a great deal of discomfort for the patient. There are numerous examples in the prior art for elevating the legs however there are a number of drawbacks associated with their use. For example, the devices may only allow for a limited number of patient positions, or not provide adequate support for the entire leg, or restrict air circulation around the skin. Several examples of these prior art devices are provided below.

U.S. Pat. No. 830,776 to Flagg describes a leg rest supported on two arms which adjust the inclination of the rest. The leg rest may be used only while the person is lying in bed, and does not permit the person to be in a sitting position. In addition, it fails to provide sufficient support under the person's leg to allow the person to be comfortable while convalescing.

U.S. Pat. No. 2,346,722 to Bowman describes a leg rest, which includes a base, a platform hingedly secured at one end to the base, and a pair of props hingedly secured along the length of the base. The free ends of the props are selectively engageable with one of two bars disposed along the length of the platform to thereby adjust the elevation and inclination of the platform. The leg rest may only be used by a person in bed.

U.S. Pat. No. 2,581,110 to Kenworthy describes an adjustable leg rest for invalids. The leg rest includes a leg support supported on a base by telescoping bars. The telescoping bars adjust the elevation and inclination of the leg support. The rigid support limits the ability of the device to provide a high degree of comfort for the patient.

U.S. Pat. No. 3,007,739 to Delia describes a leg rest, which is selectively adjustable between a first, straight position and a second, flat position. As stated above, this type of device is insufficiently flexible to provide a high degree of comfort.

U.S. Pat. No. 3,066,322 to Derby describes a leg and foot support, which includes a base section, an upper leg supporting frame section pivotably connected to the base section and a pair of braces pivotably connected to the upper leg supporting frame section and slidably connected to the base section. The inclination of the upper leg supporting section is adjustable by adjusting the braces. Although this devices provides good support for an injured leg, it can only be used by a person lying down.

U.S. Pat. No. 3,065,992 to Nagel describes an adjustable leg rest, which includes a bottom piece, a top piece and two end pieces hingedly secured to each end of the top and bottom pieces. The top piece, bottom piece and end pieces define a quadrilateral structure. This structure is too rigid for use by a person with an injured leg and is used mainly as footrest for tired feet.

U.S. Pat. No. 3,753,557 to Kelley describes a device for supporting a person's leg during knee surgery. The device includes a base, an upright hingedly connected to one end of the base and a leg support hingedly connected to an opposite end of the upright. A prop is provided so that the device may be arranged in a first configuration, wherein the base, upright and leg support define a triangular structure, and a second configuration, wherein the base, upright, leg support and prop define a quadrilateral structure. The position of the hinge connecting the upright to the base is adjustable, and the length of the upright is adjustable, but the device is not designed for long-term convalescing.

In view of the problems associated with the long-term treatment of leg injuries, it would be an advantage to have a leg supporting apparatus that can be easily and effectively adjusted over a wide range of positions and be constructed of a material conducive to comfort for the leg.

SUMMARY OF THE INVENTION

A leg support apparatus is provided for use in the health care industry for the treatment and rehabilitation of persons having leg injuries. The apparatus includes a vertical support member having a base and an adjustable and slidable support assembly. The support assembly comprising a slideably positionable clamp having at least one cradle with a sling member. The cradle is pivotally coupled to the clamp and the sling member is pivotably coupled to the cradle thereby permitting the sling member to move in an arc up or down depending of the need of the patient. The adjustability of the vertical support assembly provides for the general comfort of the patient while providing for the patient's medical needs. In addition, the sling member is made from material that allows the leg to breathe so that the leg does not develop sores or other complications.

DETAILED DESCRIPTION OF THE INVENTION

Figure 1:
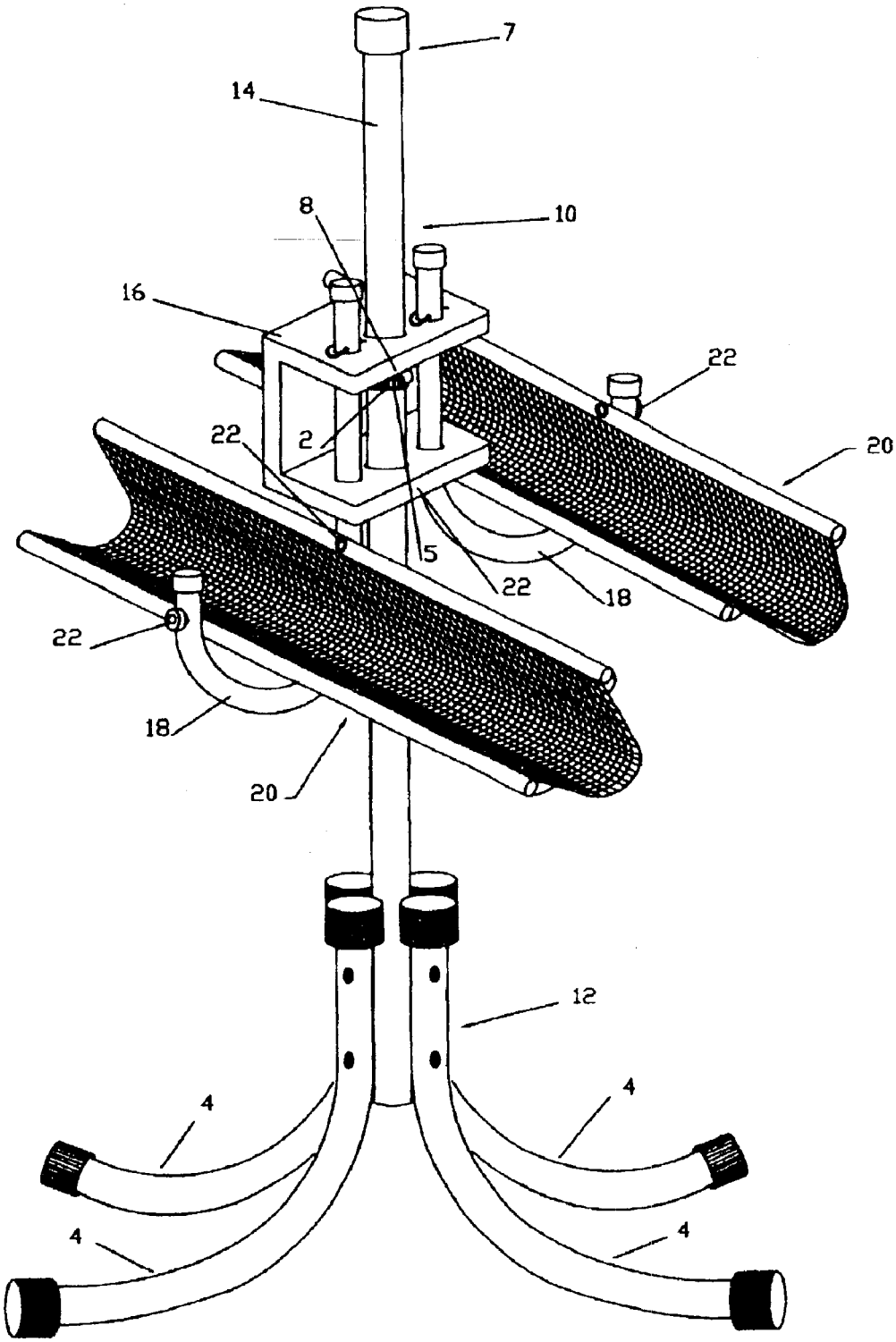
FIG. 1 is a view of an assembled leg support apparatus.
Figure 3:
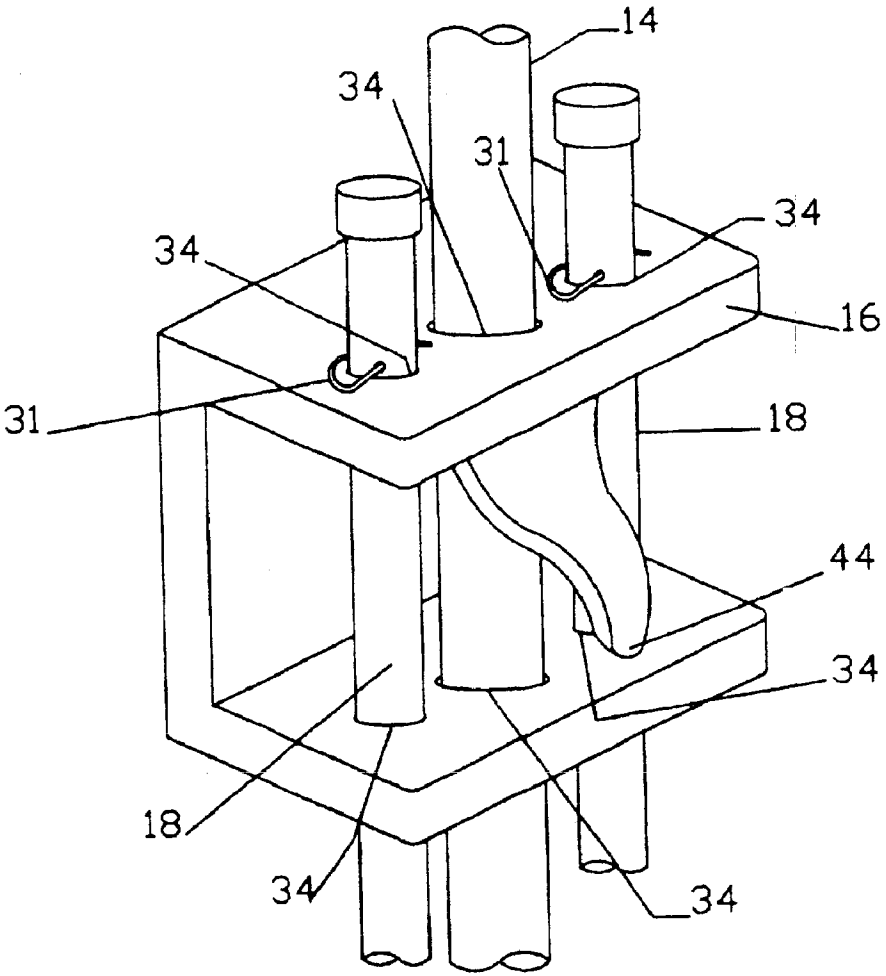
FIG. 3 is a view of an embodiment of clamp of the leg support apparatus illustrating its relationship to the leg support apparatus and the locking mechanism used to lock the clamp to the vertical member.
Figure 4:
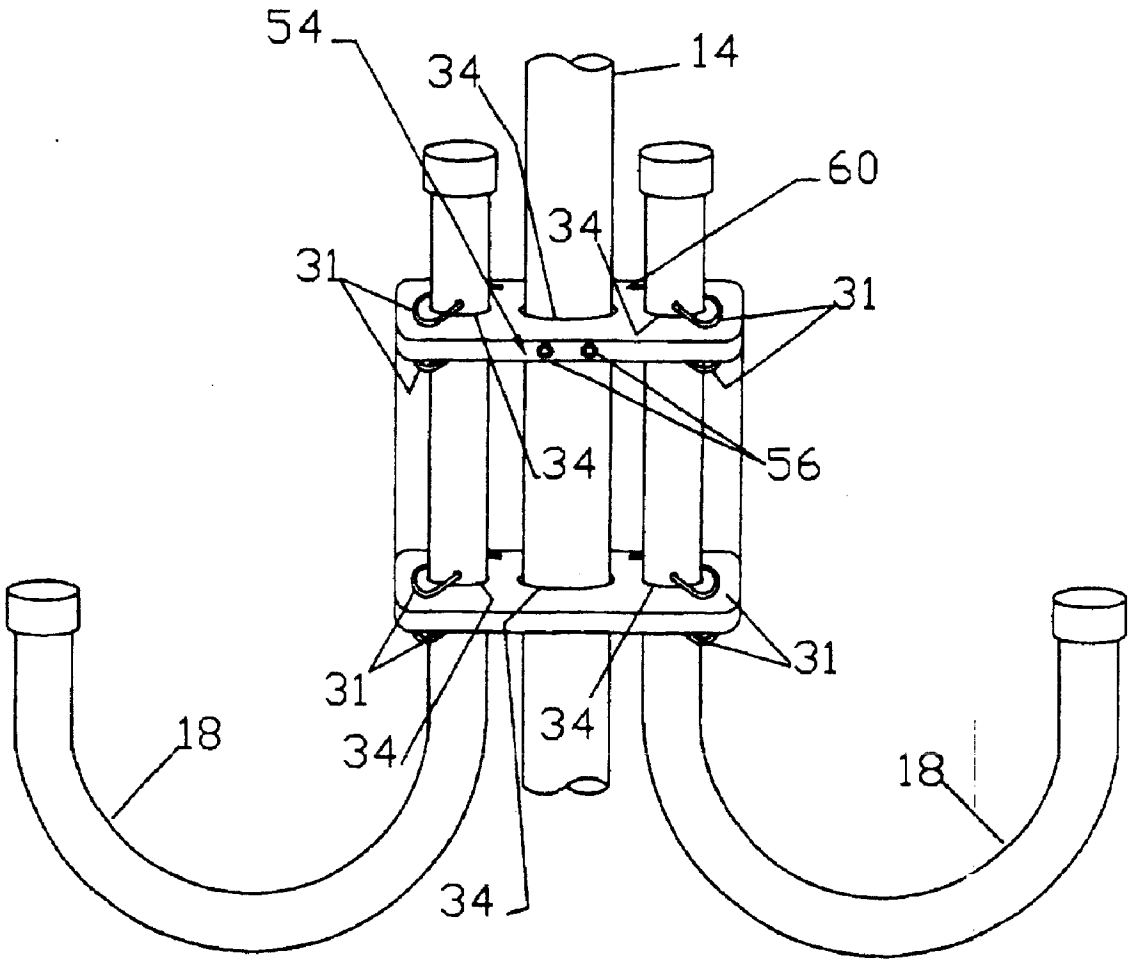
FIG. 4 is a view of another embodiment of the clamp and locking mechanism.

Referring to FIG. 1, the leg support apparatus 10 is shown assembled, as it would be when used. The apparatus 10 has a vertical member 14 with base 12 attached at one end of the vertical member 14. The base 12 comprises four legs 4 in this embodiment. Although, as shown in FIG. 1, the depicted four legs 4 are the preferred arrangement, another arrangement, not shown in the drawings, would have the legs retractable toward the vertical member 14. There is also shown a clamp 16 to secure at least one cradle 18 to the vertical member 14. Cradles 18 are pivotably coupled to clamp 16. Clamp 16 is slideably positionable on vertical member 14 and is secured in place by locking mechanism 8. In this embodiment, locking mechanism 8 is a separate adjustable stop which permits the clamp 16 to remain free floating. By changing the location of the adjustable stop 8, the clamp 16 may be positioned in whatever location is necessary for the user. The adjustable stop 8 has collar 2 and set screw mechanism 5 which frictionally engages vertical member 14. Other configurations to permit the clamp 16 to be slideably positionable on the vertical support member will be readily apparent to those of skill in the art. Alternate embodiments of the locking mechanism are shown in FIGS. 3 and 4. Referring again to FIG. 1, each sling member 20 is pivotably coupled at opposite sides to the corresponding cradle 18 with pivot fasteners 22. In a preferred embodiment, the cradles 18 pivot about an axis parallel to the vertical member 14 and the sling members 20 pivot about an axis perpendicular to the vertical member 14. Once assembled the leg support apparatus is ready for use by a patient or any person who needs to elevate the leg or foot at different heights, while convalescing after surgery or from an injury.

Figure 2:
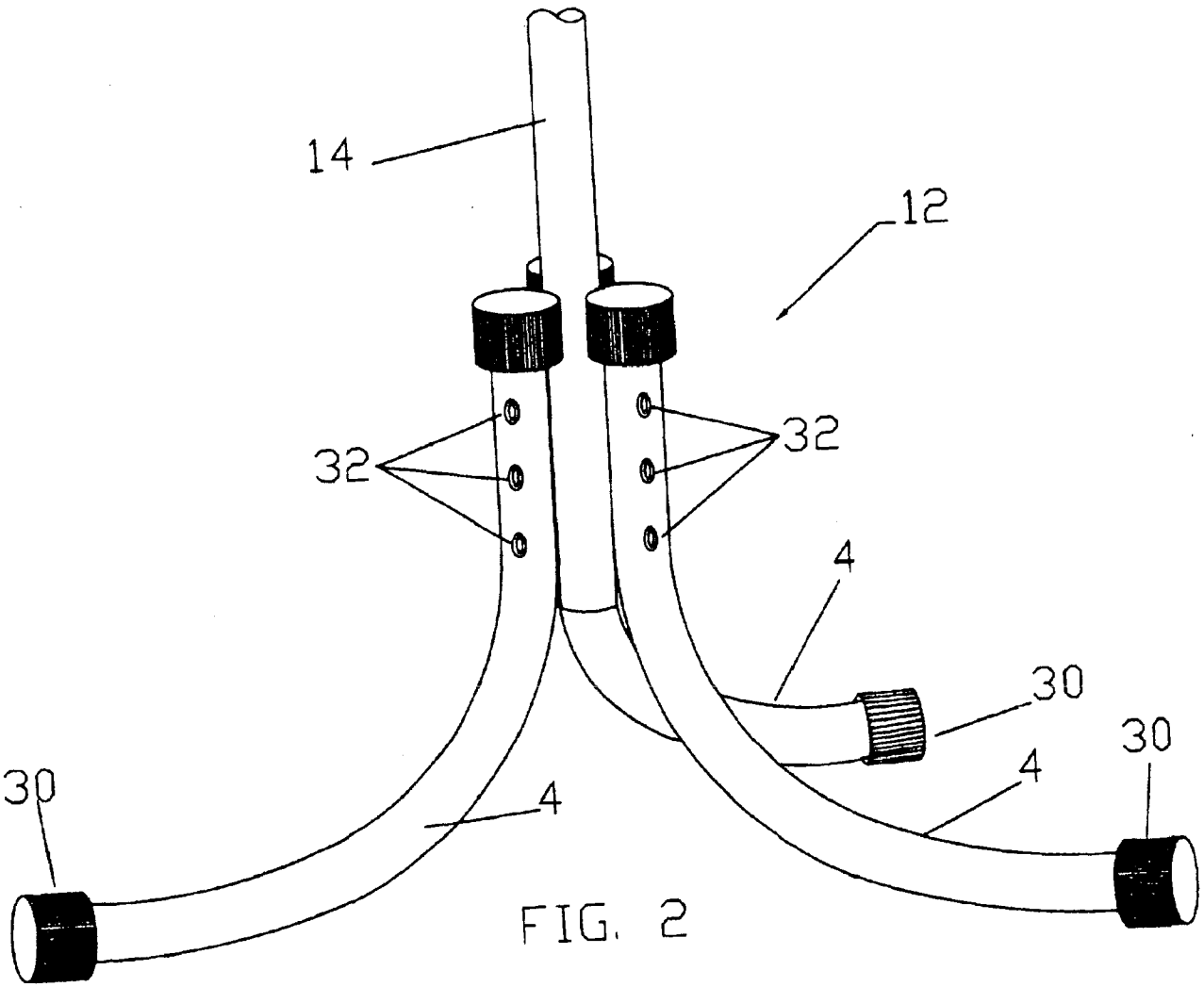
FIG. 2 is a view of the base of the leg support apparatus illustrating the vertical member and the legs.

FIG. 2 illustrates base 12 having three legs 4 in this embodiment which are attached to vertical support 14 and utilized to stabilize the leg support apparatus 10, when it is in use. The legs 4 are attached to the vertical member 14, by fasteners 32. Although several other types of fasteners may be used to secure the legs to the vertical member, e.g., small bolts, the preferred way to attach the legs to the vertical member is by ¼ inch self-tapping metal screws, using at least 3 screws per leg. The vertical member 14 and legs 4 are preferably made from ¾ inch diameter aluminum tubing or pipe, but any material, even plastic may be used, provided it has the necessary strength to support the weight of a person's leg or legs as the case may be. The support also has, at the upper most end, a cap 7 (FIG. 1) to prevent injury to someone gripping the end of the support. Although the cap 7 is preferred to be made from plastic, other material such as rubber may be used. At the lower part of the legs 4, there are attached caps 30, preferably made from plastic, but any other material would suffice as well. The caps 30 are used to prevent the support from sliding or moving suddenly while the support is in use.

Referring now to FIG. 3, there is shown a view of clamp 16. The clamp 16 as shown is preferably made from ⅜ inch aluminum channel, but other configurations may be used, such as a ⅜ inch flat shape. The clamp 16 may also be made from different types of material including plastic. The clamp 16 has three bores 34 through the clamp 16. The bores 34 permit the vertical member 14 and cradles 18 to pass through the clamp 16. In this embodiment, the clamp 16 is secured and positioned on the vertical member 14 by thumb latch 44. The thumb latch 44 secures the clamp 16 by frictionally engaging the vertical member 14. The cradle 18 is secured in position to the clamp 16 by inserting pins 31, preferably ⅛×1¼ inch cotter pins, through drilled holes in cradles 18 after the cradles 18 are positioned in the bore 34.

FIG. 4 is a view of another embodiment of clamp 16. Here, the cradles 18 are secured to the clamp 16 by multiple pins 31 positioned above and below the points where the cradles 18 pass through the bores 34. The cradles 18, although preferably made from ½ inch aluminum tubing, may be made from other suitable materials. In this embodiment, the locking mechanism 54 of claim 16 is an integral part of the clamp 16. The locking mechanism is formed by clamp screws 56 and channel 60 which connects bores 34. As the clamp screws 56 are tightened, the channel 60 narrows and locking mechanism 54 frictionally engages vertical member 14 to secure clamp 16.

Figure 5:
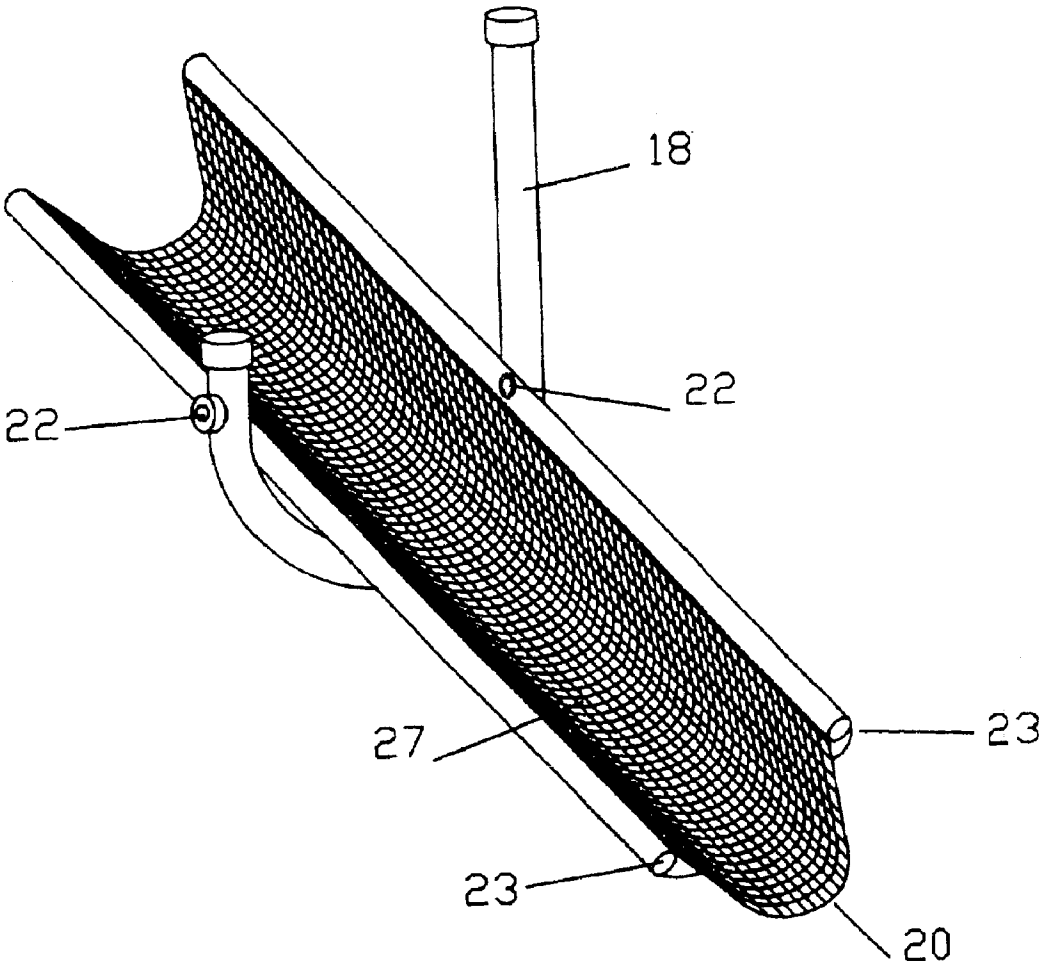
FIG. 5 is a view illustrating the sling member of the leg support apparatus and its attachment to the cradle.

FIG. 5 is a view of a sling member 20 which is attached to cradle 18. The sling member 20 consists of sling supports 23 and sling 27. The sling supports 23 of the sling member 20 are preferably made from ½ inch aluminum tubing, but other suitable material may be used. The sling supports 23 and the cradle 18 each have corresponding drilled holes permitting the insertion of pivot fasteners 22, preferably ¼ inch diameter×1¼ inch length shoulder screws, through the sling supports 23 and through the cradle 18 thereby securing the cradle 18 and the sling supports 23 together. This arrangement permits the sling members 20 to rotate around the pivot fasteners 22 in an arc so that the sling members 20 may tilt up or down depending on what position the user may require. The sling 27 is preferably made from a mesh fabric which allows air to circulate around the supported leg. The sling 27 may be made from other similar breathable materials provided the material allows air circulation to the leg. This is important because proper air circulation to the skin of the leg reduces the accumulation of perspiration, promotes healing of injured tissue, and reduces the possibility of bed sores or other skin problems. The sling 27 is fashioned with longitudinal openings down each side so that the sling supports 23 may be inserted therethrough. Once the leg support is assembled the user may then position the slings and the height of the cradles to his or her liking.

While there has been shown and described what are at the present considered the preferred embodiments of the invention, it will be obvious to those skilled in the art that various changes and modifications may be made therein without departing from the scope of the invention as defined by the appended claims.

What is claimed is:

1. A leg support apparatus comprising: a vertical member having a base, a clamp slideably positionable on the vertical member, a cradle pivotably coupled to the clamp, a sling member pivotably coupled to the cradle, the sling member having a sling which is comprised of a breathable material for air circulation to the leg.

2. The apparatus of claim 1 wherein the base comprises at least three legs attached to the vertical support member.

3. The apparatus of claim 1 wherein the clamp has bores therethrough for receiving the vertical member and the cradle.

4. The apparatus of claim 1 wherein the cradle is pivotably coupled to the sling member by a shoulder screw.

5. The apparatus of claim 1 wherein an adjustable stop is used to position the clamp on the vertical member.

6. The apparatus of claim 1 wherein the sling material is mesh fabric.

7. The apparatus of claim 1 wherein the apparatus has two cradles pivotably coupled to the clamp at opposite sides of the clamp, each cradle having a sling member pivotably coupled thereto.

8. The apparatus of claim 7 wherein the cradles pivot about an axis parallel to the vertical member and the sling members pivot about an axis perpendicular to the vertical member.

9. A leg support apparatus comprising: a vertical member having a base, a clamp slideably positionable on the vertical member, the clamp having a locking mechanism for engaging the vertical member, two cradles pivotably coupled to the clamp at opposite sides of the clamp, each cradle having a sling member pivotably coupled to the cradle, each sling member having a sling which is comprised of a breathable material for air circulation to the leg.

10. The apparatus of claim 9 wherein the cradles pivot about an axis parallel to the vertical member and the sling members pivot about an axis perpendicular to the vertical member.

11. The apparatus of claim 9 wherein the vertical member passes through a bore in the center of the clamp and the cradles pass through bores at opposite ends of the clamp.

12. The apparatus of claim 11 wherein the locking mechanism comprises two clamp screws and a channel connecting the bores at the opposite ends of the clamp and the bore in the center of the clamp, the clamp screws being located on opposite sides of the bore in the center of the clamp and acting to narrow the channel when tightened.

13. The apparatus of claim 9 wherein the locking mechanism is a thumb latch which frictionally engages the vertical member.

14. The apparatus of claim 9 wherein the slings are formed with longitudinal openings on opposite sides, each opening containing a sling support which is pivotably coupled to the corresponding cradle.

15. The apparatus of claim 14 wherein the sling supports are pivotably coupled with shoulder screws.

16. The apparatus of claim 11 wherein the slings are formed with longitudinal openings on opposite sides, each opening containing a sling support which is pivotably coupled to the corresponding cradle.

17. The apparatus of claim 9 wherein the sling material is a mesh fabric.

18. The apparatus of claim 16 wherein the cradles pivot about an axis parallel to the vertical member and the sling members pivot about an axis perpendicular to the vertical member.

* * * * *